US006047897A

United States Patent [19]

Ueno et al.

[11] Patent Number: 6,047,897

[45] Date of Patent: Apr. 11, 2000

[54] SPRINKLER SYSTEM AND SPRINKLING METHOD FOR VEHICLE RUNNING TEST COURSE

[75] Inventors: Hiroshi Ueno, Yokohama; Mitsuru Kawamura, Tokyo, both of Japan

[73] Assignee: Marubeni Plant Contractor, Inc., Indianapolis, Ind.

[21] Appl. No.: 09/176,582

[22] Filed: Oct. 21, 1998

[51] Int. Cl.[7] ..... B05B 17/00

[52] U.S. Cl. ..... 239/1; 239/202; 239/201; 239/200; 73/146; 404/2

[58] Field of Search ..... 239/1, 200, 201, 239/202; 404/1, 2; 73/146

[56] References Cited

U.S. PATENT DOCUMENTS

| | | | |
|---|---|---|---|
| 218,024 | 7/1879 | Hennessy et al. | 239/202 |
| 479,979 | 8/1892 | Glenn | 239/202 |
| 789,588 | 5/1905 | Case | 239/202 |
| 802,772 | 10/1905 | McCoy | 239/202 |
| 917,614 | 4/1909 | Kennedy | 239/202 |
| 3,269,281 | 8/1966 | Carter | 404/1 |
| 3,540,655 | 11/1970 | Hinrichs | 239/202 |
| 3,713,492 | 1/1973 | Forrest | 239/202 |

*Primary Examiner*—Kevin Shaver
*Assistant Examiner*—David Deal
*Attorney, Agent, or Firm*—Bose McKinney & Evans LLP

[57] ABSTRACT

A sprinkler system for a vehicle running test course having an incline in the direction of the width of the vehicle running test course such that said vehicle running test course has a higher side and a lower side. The sprinkler system including a concave placement channel constructed on one or both sides of the vehicle running test course; multiple sprinklers capable of sprinkling water over the vehicle running test course being installed in the concave placement channel; a concave installation channel constructed on the higher side of the vehicle running test course; and multiple water sprinkler nozzles placed in the concave installation channel. The water sprinkler nozzles sprinkle water onto the higher side of the vehicle running test course such that the sprinkled water flows downward along the surface of the vehicle running test course toward the lower side of the vehicle running test course.

18 Claims, 6 Drawing Sheets

SPRINKLER SYSTEM AND SPRINKLING METHOD FOR VEHICLE RUNNING TEST COURSE

FIELD OF THE INVENTION

This invention relates to a sprinkler system and sprinkling method for a vehicle test course. More particularly, the invention concerns a sprinkler system and sprinkling method for sprinkling water over a vehicle test course for the purpose of testing vehicle slippage, tire performance and vehicle running performance in relation to precipitation, and preventing tire seizure due to friction while running.

BACKGROUND OF THE INVENTION

It is conventional in providing a sprinkling method for a vehicle test course to embed sprinklers in the vehicle test course for sprinkling water over the vehicle test course for the purpose of testing vehicle slippage, tire performance and vehicle running performance in relation to precipitation, and for preventing tire seizure due to friction while running. These sprinklers sprinkle water in the shape of a parabola or as a mist from the installation surface of the sprinkler at a high jet angle in the direction of the axis, so that water reaches far from the sprinkler to allow the sprinkling of water over the entire surface of the test course.

When a sprinkling operation is performed by these sprinklers during vehicle running tests, the water ejected by the sprinklers onto the test course hits the windshield or windows of the vehicle directly and obstructs the driver's field of view or driving operations, which can lead to an accident. Particularly during a running test for motorcycles, water hits the rider directly, applying impact or causing the rider's body to get soaking wet so that it becomes impossible to conduct a stable running test. In these respects, the conventional method has undesirable effects of worsening the operating environment by decreasing the efficiency of testing and causing falls and other accidents.

One such conventional method for preventing the aforementioned situations, which has been practiced, is to terminate the sprinkling operation after sufficient water has been sprinkled. A vehicle is then operated after the termination of the sprinkling operation. However, with this method, time is wasted and operating efficiency is decreased, while the volume of water present over the road surface becomes uneven. Therefore, desirable running tests cannot be conducted.

Accordingly, a need exists for an improved sprinkler system and method which addresses the problems associated with such conventional systems.

SUMMARY OF THE INVENTION

The present invention provides for a sprinkler system whereby water can be sprinkled onto a vehicle test course efficiently without obstructing the driver's control or deteriorating the operating environment, even while the vehicle is running.

To this end, a rapid-sprinkle operation is performed over the vehicle test course having an inclined surface using sprinklers prior to running the vehicle test so that preparatory work for the vehicle test can be completed efficiently. During the vehicle test, water is sprinkled only onto the higher side of the inclined surface of the test course using sprinkler nozzles so that the water flows downward along the inclined surface. In this way, the invention achieves its purpose of preventing direct water impact on vehicles and drivers while sprinkling sufficient amounts of water over the entire surface of the test course.

In addition, the sprinkler system of the present invention does not hinder test operations when a vehicle slalom test is conducted on the test course. This invention also provides a means to prevent damage to the sprinkler system, even when a tire on the vehicle comes into contact with the sprinkler system.

Furthermore, by configuring a sprinkler nozzle adjustable for water volume, this invention provides a means to simulate a variety of precipitation conditions according to the purpose of the test. At the same time, the invention attempts to enable efficient conduct of the test by providing uniform sprinkling with the use of multiple sprinkler nozzles. The invention also allows the construction of an inexpensive sprinkler system by providing the water-volume adjustment function using a simple means.

In the specification of the present invention, the definition of "vehicle" does not include only those entities that travel exclusively on the ground by means of appropriate driving force, but entities such as airplanes are also included as vehicles as long as they travel on the ground.

A sprinkler system of the present invention includes a concave placement channel, multiple sprinklers, a concave installation channel and water sprinkler nozzles. The concave installation channel for sprinkler placement is constructed on one or both sides of a vehicle running test course having an incline in the direction of the width of the course. The multiple sprinklers which are capable of sprinkling water over the test course are placed at constant intervals in the concave placement channel. The concave installation channel for the installation of water sprinkler nozzles is constructed on the higher side of the inclined cross section of the test course. The water sprinkler nozzles, which sprinkle water onto the higher side of the inclined surface of the test course in such a way that the water sprinkled flows downward toward the lower side along the inclined surface, are placed in the concave installation channel at constant intervals.

A method of the present invention for sprinkling water over a test course using the sprinkler system described above includes the steps of: performing the sprinkling operation which consists of sprinkling water from the sprinklers placed on one or both sides of the vehicle running test course having an incline in the direction of the width of the course with such a force that the sprinkled water reaches the entire surface of the test course; terminating the sprinkling operation; and opening the sprinkler nozzles placed on the higher side of the incline of the cross section of the test course in order to spray water onto the higher side of the inclined surface, whereby the sprinkled water flows downward toward the lower side along the inclined surface of the test course, thus sprinkling the entire surface of the test course.

The sprinkler nozzles may be installed in the upper face of the concave installation channel for sprinkler-nozzle installation in such a way that the face of the sprinkler head having a jet nozzle is flush with the test course, while said sprinkler head and a water-conduit pipe installed at a lower position inside the concave placement channel are connected by a water-supply pipe.

The sprinkler nozzle may be constructed with a chamber for water-volume adjustment in the jet water passage of the sprinkler head, which is connected to the water-supply pipe. An open-shut block is located inside the adjustment chamber and is rotatable within the adjustment chamber. An adjustment screw protrudes upward from the sprinkler head and is affixed to the open-shut block. By rotating the adjustment screw, the open-shut block rotates in the horizontal direction, so that the degree of opening of the jet passage can be adjusted according to the amount of rotation, which in turn adjusts the volume of the water jet.

The concave placement channel and concave installation channel may be constructed separately. The concave placement channel may be the same as the concave installation channel in which sprinklers and sprinkler nozzles are arranged at constant intervals.

In accordance with the aforementioned construction of the present invention, when performing the sprinkling operation on the vehicle test course, the sprinklers are installed along the test course and are operated to perform the sprinkling operation. The sprinklers can be any device using known conventional technology with which water is sprinkled via hydraulic pressure in the form of a fountain or parabola, and which is capable of sending the water over a large distance. In this way, it is possible to sprinkle water rapidly and uniformly over the entire surface of the test course, which in turn makes it possible to efficiently carry out the preparatory work for testing. In addition, the sprinklers may be provided on one or both sides of the test course, depending on the width of the test course and the effective sprinkling distance of the sprinkler.

When water is appropriately sprinkled over the entire surface of the test course using the sprinklers, the sprinkling operation is terminated and a vehicle running test is conducted. During the test, the sprinkling operation using the sprinkler nozzles is performed to prevent the road surface from drying. This sprinkling operation is performed by sprinkling water from the sprinkler nozzles installed on the higher side of the inclined surface of the test course. The sprinkler nozzles sprinkle water only onto the higher side of the inclined surface. The water sprinkled onto the higher side of the inclined surface naturally flows downward over the inclined surface toward the lower side. Therefore, water can be supplied over the entire surface of the test course without ejecting water over a great distance.

Since the sprinkling operation during the vehicle running test is performed in such a manner that water is sprinkled only onto the higher side of the inclined surface so that the water flows downward over the inclined surface, the desired test can be conducted efficiently and safely without obstructing the driver's field of view or wetting the rider's body. In addition, because water can be supplied continuously from the sprinkler nozzles, time lost as a result of stopping the sprinkling operation to ensure the safety of the running vehicle/driver can be eliminated completely, and the operating efficiency of the running test can be improved due to the uniform water volume present over the test course.

Any appropriate sprinkler nozzles using known conventional technology can be employed as long as they can sprinkle water only onto the higher side of the inclined surface of the test course. When the sprinkler head, which has the sprinkler nozzle, is installed flush with the surface of the test course, the sprinkler nozzle will not be damaged even when the vehicle drives over the sprinkler nozzle, thus allowing running tests to be conducted smoothly.

Multiple sprinkler nozzles can be connected to the water-conduit pipe in series. In such a series configuration, the multiple sprinkler nozzles are installed at constant intervals and are connected via water-supply pipes to the water conduit pipe which is installed at a lower position in the concave installation channel. When water is supplied to the water-conduit pipe, the water is supplied to each sprinkler nozzle via the water supply pipe so that the sprinkling operation can be performed by all sprinkler nozzles at the same time.

However, if multiple sprinkler nozzles are connected in series to a single water-conduit pipe as mentioned above, water pressure in the water-conduit pipe decreases as the distance from the water-supply source increases. Thus, different water supplies would result between sprinklers located closer to the water-supply source and those located farther away from it. This makes it impossible to sprinkle water uniformly from each sprinkler nozzle onto the test course, and the acquisition of precise test data becomes difficult. For this reason it is desirable to provide a mechanism with which the volume of water supplied to the sprinkler nozzle can be adjusted to eliminate the uneven sprinkling condition and achieve a uniform sprinkling operation. Also, by providing this water-volume adjustment mechanism to the sprinkler nozzle, the test course can be set for various conditions such as heavy rain or drizzle, according to the purpose of the test and weather.

In addition, the concave placement channel and concave installation channel may be constructed separately, each with sprinklers and sprinkler nozzles installed inside. Alternatively, the concave placement channel and concave installation channel may be constructed as one channel, in which the sprinklers and sprinkler nozzles are installed at constant intervals. It is desirable to design a sprinkler system intended by the present invention according to the size of the test course to which the system will be installed, as well as the available budget.

Additional objects, advantages and novel features of the invention are set forth in the description that follows, and will become apparent to those skilled in the art upon reviewing the drawings in connection with the following description.

DETAILED DESCRIPTION OF THE PREFERRED EMBODIMENT

Figure 1:
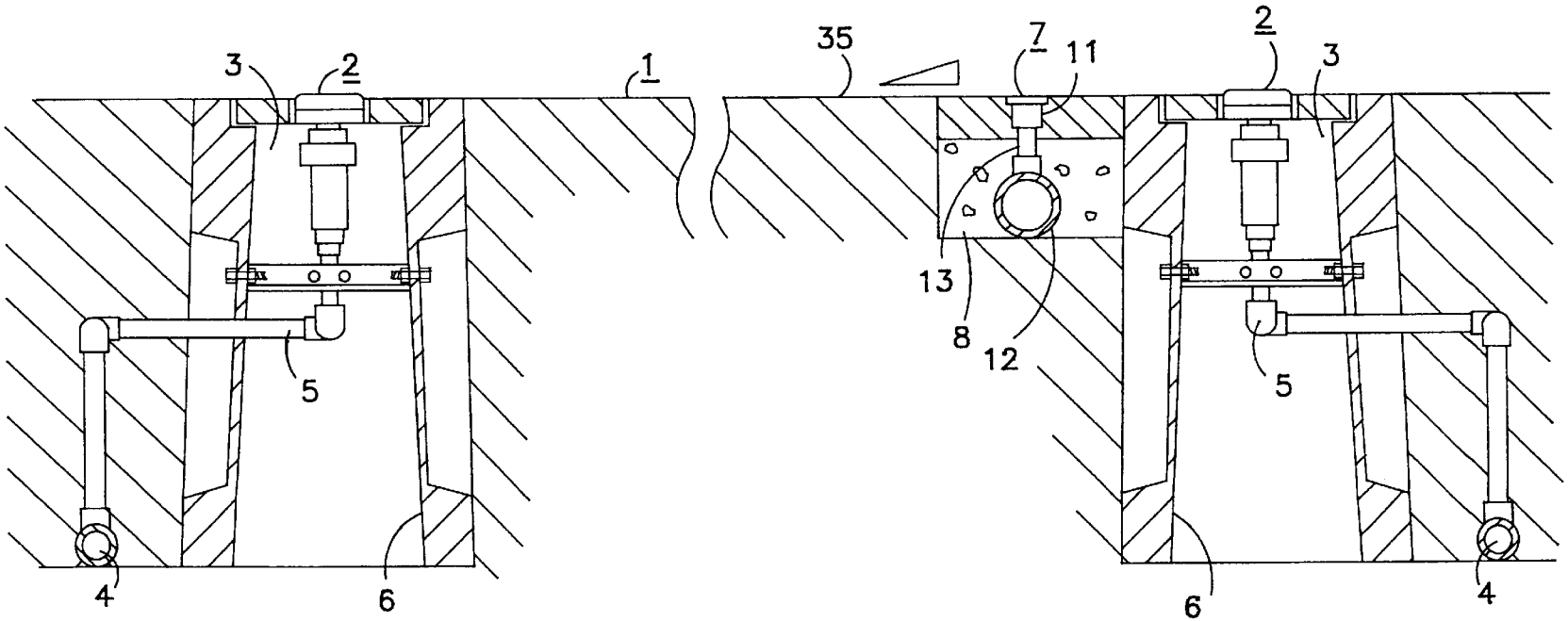
FIG. 1 is a cross-sectional view of the vehicle running test course, including sprinklers and sprinkler nozzles.

FIG. 1 shows a vehicle running test course 1, which is paved with material such as asphalt, concrete or tiles, and is constructed to have an incline in the direction of its width. A concave placement channel 3 for a sprinkler 2 is constructed on both sides of the test course 1, as shown in FIG. 1. A water-conduit pipe 4 that supplies water to the sprinkler 2 is embedded inside the concave placement channel 3. This water-conduit pipe 4 is connected to the water-supply source (not shown in the figure) via a pump (not shown in the figure).

In addition, multiple sprinklers 2 are inserted and installed in series in the concave placement channel 3 at selected intervals. The preferred placement interval is 1.8 meters.

The sprinkler 2 and water-conduit pipe 4 installed outside of the concave placement channel 3 are connected by a water-supply pipe 5. As shown in FIG. 1, the water-supply pipe 5 is affixed to a support frame 6 provided inside the concave placement channel 3 to secure the whole sprinkler device 2. Moreover, any sprinkler using known conventional technology can be adopted for the sprinkler 2, as long as it can sprinkle water far within the test course 1. Water can be sprinkled in an appropriate shape such as a fountain or cylinder, or as a mist.

While the sprinklers 2 are provided on both sides of the test course 1 in this implementation example, they may be provided only on one side, depending upon the width of the test course 1 and the effective sprinkling distance of the sprinkler 2. In either case, they are installed in such a way that the sprinklers 2 can sprinkle water over the entire surface of the test course 1 in a uniform manner. It is desirable to install the sprinklers 2 at intervals between 1.8 m and 22.0 m, depending upon the amount of water ejected and the size of the test course 1. If the sprinklers 2 are installed at intervals narrower than 1.8 m, manufacturing and installation costs will increase. On the other hand, if the sprinklers 2 are installed at intervals greater than 22.0 m, the sprinklers 2 using known conventional technology may not be able to sprinkle water over the entire surface of the test course 1, thereby causing the surface to be unevenly covered with water or requiring the sprinkler system to be operated for a longer period of time in order to prepare for a given test.

A concave installation channel 8 for a multiplicity of sprinkler nozzles 7 is constructed on the higher side of an inclined surface 35 of the test course 1. Inside the concave installation channel 8, the multiple sprinkler nozzles 7 are installed at intervals. The preferred interval for placement of the sprinkler nozzles 7 is 3.0 m. A sprinkler head 11 of the associated sprinkler nozzle 7 is installed in such a way that a water jet nozzle 10 is flush with the surface of the test course 1. Moreover, a water-conduit pipe 12 is installed at a lower position in the concave installation channel 8, which is connected to the water-supply source (not shown in the figure) via a pump (not shown in the figure).

Figure 4:
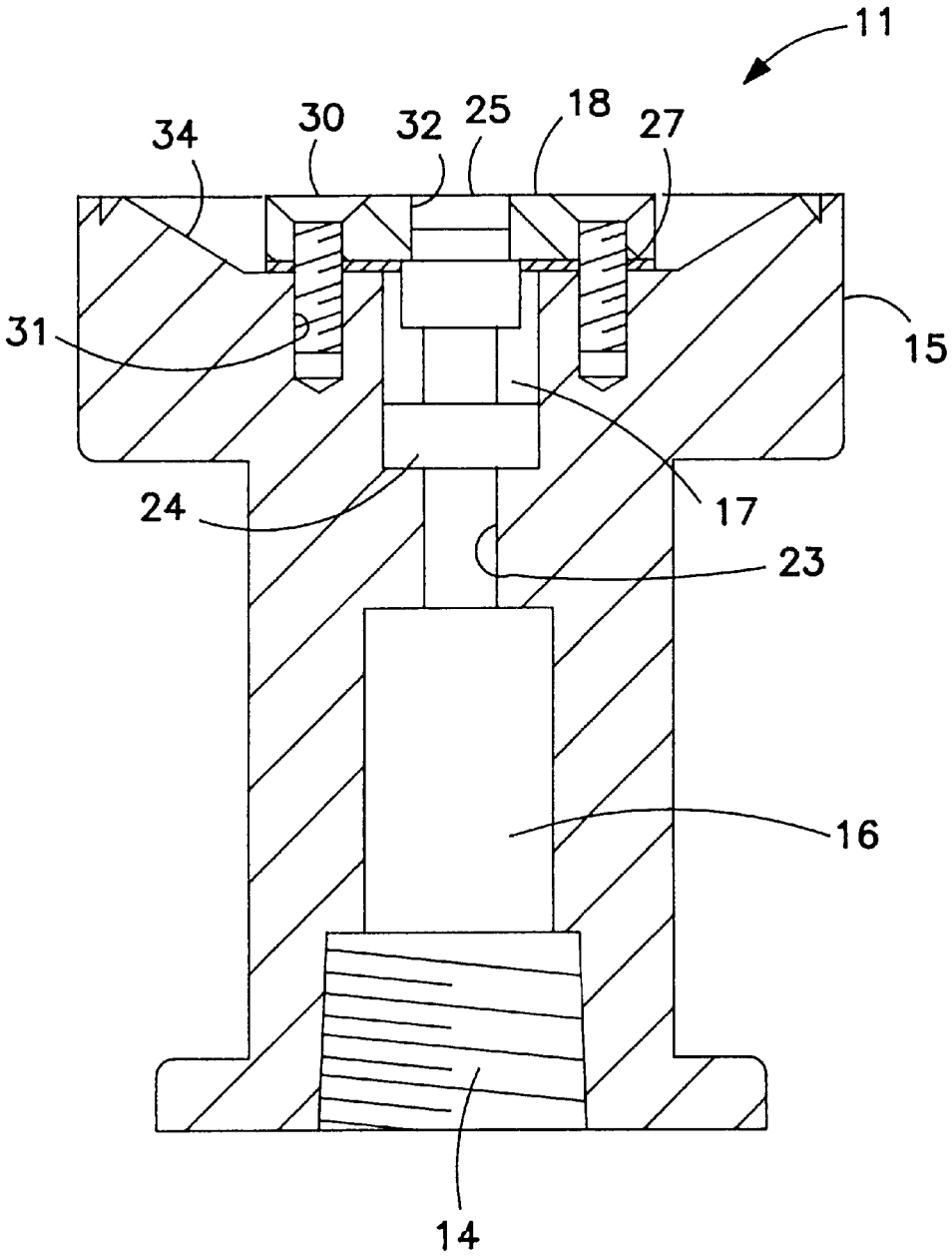
FIG. 4 is a cross-sectional view of the sprinkler head along line A—A of FIG. 3.
Figure 5:
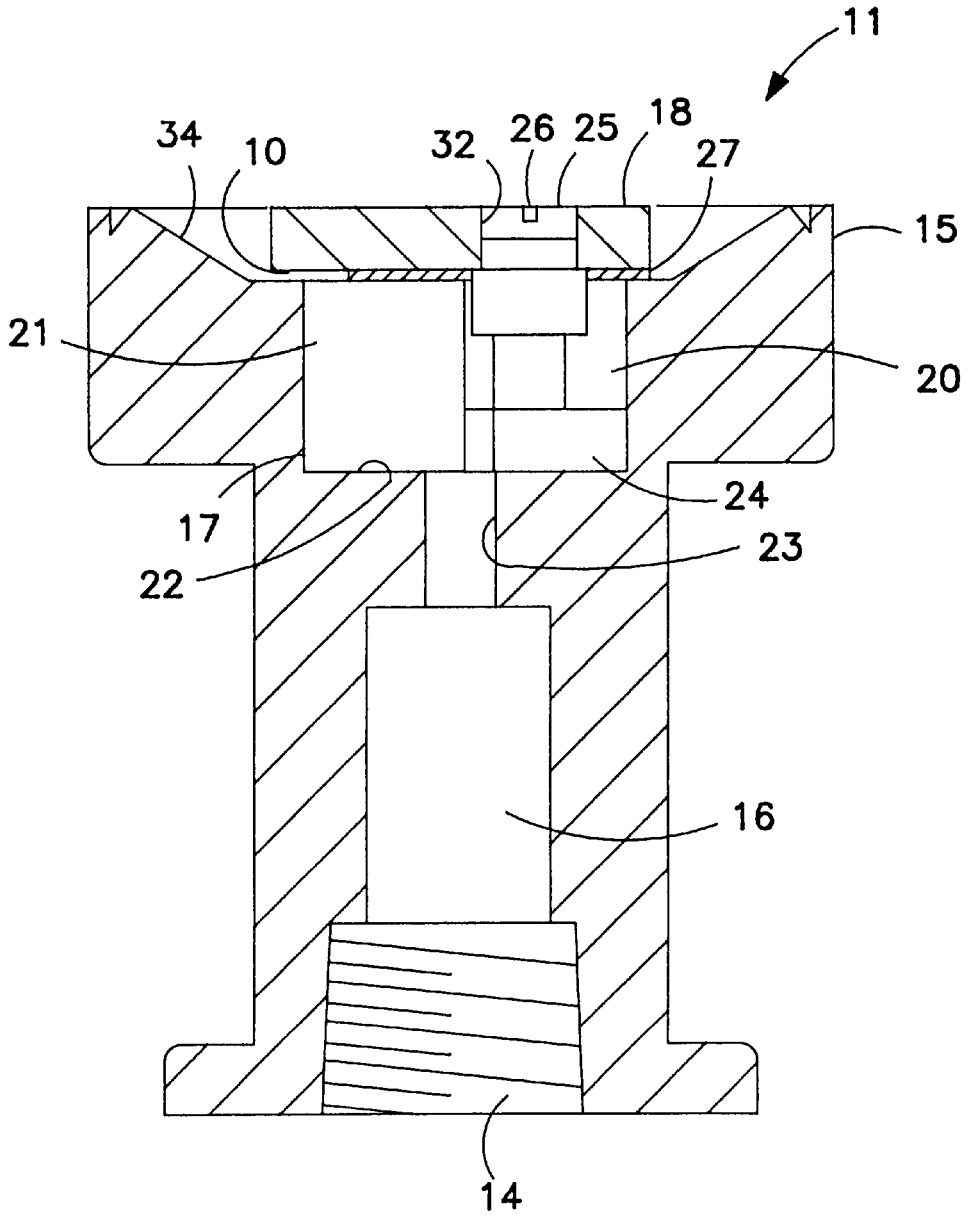
FIG. 5 is a cross-sectional view of the sprinkler head along line B—B of FIG. 3.

By connecting the water conduit pipe 12 and the sprinkler head 7 with a water-supply pipe 13, it is possible to sprinkle water from the jet nozzle 10 of the sprinkler head 7. Internal threads 14 are cut into the inner circumference at the bottom edge of the sprinkler head 11, as shown in FIGS. 4 and 5, over which the water-supply pipe 13 is screwed in so that the sprinkler head 11 and water-supply pipe 13 are connected, ensuring water-tightness.

Next, the construction of the sprinkler head 11 in this implementation example is explained, referring to FIGS. 2 through 5. The sprinkler head 11 includes a head body 15 with a cross section having the shape of a letter T, and being made of metal such as brass. Inside the head body 15, a water jet passage 16 is provided. The water-supply pipe 13 and jet passage 16 are connected by screwing in the water-supply pipe 13 over the internal threads 14 cut into the inner circumference of the jet passage 16 at the bottom edge. A water-volume adjustment chamber 17 is provided in the upper part of the water-injection side of the jet passage 16.

Figure 2:
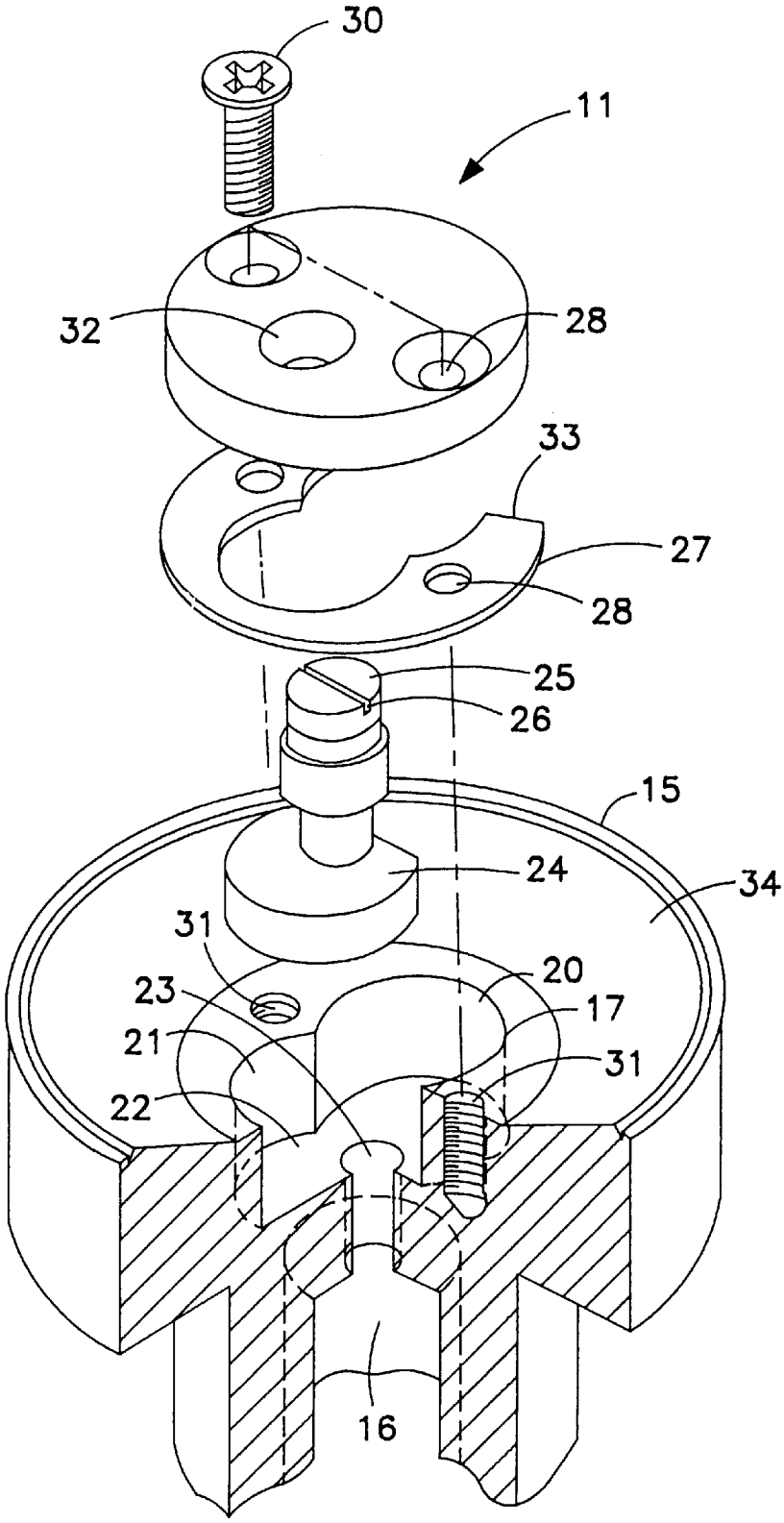
FIG. 2 is an exploded view of a sprinkler head with a portion cut away.
Figure 3:
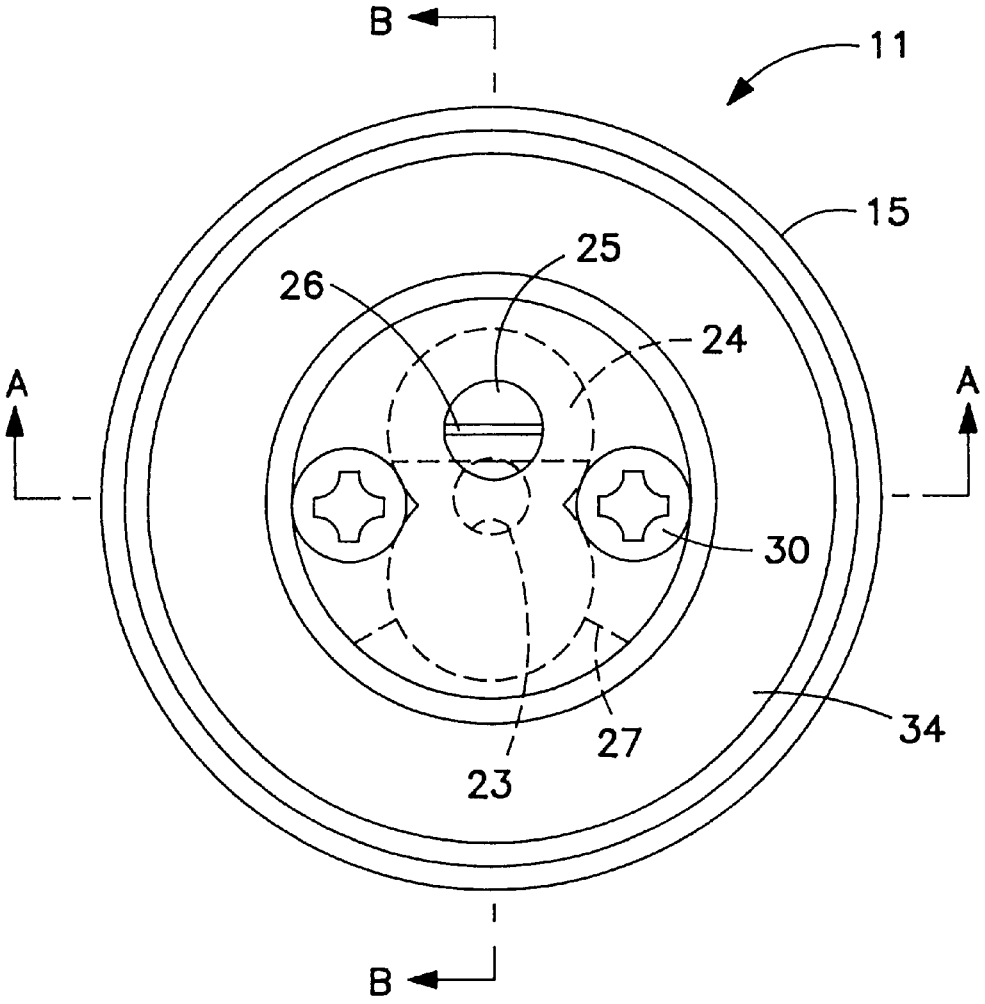
FIG. 3 is a top plan view of the sprinkler head.

The adjustment chamber 17, whose upper face is covered with a cap piece 18, is partitioned into a first cylindrical compartment 20 and a second cylindrical compartment 21. The compartments are connected to each other, forming a shape of incomplete circles. The opening of a water inlet 23 of the jet passage 16 is provided at the bottom part 22, which connects with the first compartment 20 and the second compartment 21. A cylindrical open-shut block 24 is provided inside the first compartment 20 in such a manner that it can rotate in the horizontal direction. The open-shut block 24 is formed as a cylinder that is partially cut out in the axial direction as shown in FIGS. 2 and 3, and is usually positioned in such a way that the cut side faces the water inlet 23 so as to open the water jet passage 16 widely. As the open-shut block 24 rotates inside the first compartment 20, the water inlet 23 is partially covered in accordance with the amount of rotation. Thus, by adjusting the amount of coverage, the amount of water supplied to the sprinkler head 11 can be adjusted.

An adjustment screw 25 is affixed to the open-shut block 24. The adjustment screw 25 protrudes from the open-shut block 24. By rotating the adjustment screw 25, the rotation of the open-shut block 24 is obtained. The open-shut block 24 can be rotated by inserting a flathead screwdriver or similar tool into a concave slot 26 formed on the top face of the adjustment screw 25 and rotating it in the horizontal direction.

A gasket 27, formed from rubber or similar material is provided between the cap piece 18 and the adjustment chamber 17. An inner section of the circular rubber part of the gasket 27 is cut out in the shape of two conjoined spheres, as shown in FIG. 2, in such a way that it matches the shape of the adjustment chamber 17, while a fan-shaped cut section 33 is opened toward the second compartment 21. Because of the cut section 33 on the gasket 27, the jet nozzle 10 with which water can be sprinkled over great width in the horizontal direction is formed between the top face of the cap piece 18 and the upper face of the head body 15, as shown in FIG. 3. In the case of this implementation example, by cutting out a section of the gasket 27 in the shape of a fan having an angle of 120 degrees, the sprinkle angle of the jet nozzle 10 in the horizontal direction is set to 120 degrees.

By inserting bolts 30 into corresponding insertion openings 28 provided on the cap piece 18 and the gasket 27 from the upper side of the cap piece 18 and screwing the bolts 30 into corresponding bolt holes 31 bored in the head body 15, the cap piece 18 and the gasket 27 are affixed to the head body 15. The cap piece 18 and the gasket 27 seal the adjustment chamber 17, ensuring water tightness and preventing water leakage from the outer circumference except from the jet nozzle 10. The adjustment screw 25 is made adjustable from the external surface by exposing the top face of the adjustment screw 25 through a screw hole 32 bored in the upper face of the cap piece 18. The adjustment screw 25 can be used to adjust the open-shut block 24.

With respect to the sprinkler head 11, a depression 34 tapered toward the center is provided on the top face of the head body 15, as shown in FIGS. 4 and 5. By placing the cap piece 18 and the adjustment screw 25 on the tapered depression 34, the upper face of the sprinkler head 11 can be configured flat. In addition, as shown in FIG. 1, the sprinkler nozzles 7 are installed inside the concave installation channel 8, and constructed on the higher side of the inclined surface of the test course 1 in such a way that they are flush with the surface of the test course 1. With respect to this arrangement, to enable water to be sprinkled over the test course 1, the water jet nozzle 10 of the sprinkler nozzle 7 is positioned to aim toward the lower side of the inclined surface of the test course 1.

Moreover, gravel or similar material is charged inside the concave installation channel 8 to cover the water-conduit pipe 12, water-supply pipe 13 and sprinkler head 11. With respect to the road-surface side, by covering the outer circumference of the sprinkler head 11 with the same paving material as used for the test course 1, the whole sprinkler nozzle device 7 is secured. Therefore, even when the vehicle runs over the sprinkler nozzle 7, no damage will be inflicted on the sprinkler nozzle 7 and the running of the vehicle will not be obstructed.

With respect to the system configured as described above, to perform a sprinkling operation over the test course 1, operate the pump for the sprinkler 2 to supply water from the water-supply source to the water-conduit pipe 4 of the sprinkler 2. Water is supplied from the water conduit pipe 4 to the water-supply pipe 5, which is provided for each of the multiple sprinklers 2. The water thus supplied is ejected from the installation surface of the sprinkler 2 into the air above the test course 1 at a high spray angle. Thus, water can be sprinkled over the test course 1 thoroughly, covering points that are distantly located from where the sprinkler is installed.

As described above, by sprinkling water over the test course 1 using the sprinkler 2, a rapid sprinkling operation over the entire dry road surface becomes possible, and preparatory work for the running test can be carried out efficiently. When the entire surface of the test course becomes appropriately wet, the sprinkle operation from the sprinkler 2 is terminated so that the vehicle running test can be started.

During the vehicle running set, water is supplied continuously over the test course 1 through the sprinkling operation of the sprinkler nozzles 7 so that drying of the road surface can be prevented and the running test can be continued smoothly without disruption. This sprinkling operation is performed in the following manner. Water is supplied from the water-supply source to the water-conduit pipe 12 for the sprinkler nozzle 7 by operating the pump connected to the sprinkler nozzle 7, which is installed on the higher side of the inclined cross section of the inclined surface 35 of the test course 1. The water flows into the jet passages 16 of the respective sprinkler heads 11 via multiple water-supply pipes 13 connected to the water-conduit pipe 12 in series.

The water that passes through the jet passage 16 enters the adjustment chamber 17 via the water inlet 23, and is then ejected only to the higher side of the inclined surface 35 of the test course 1 from the jet nozzle 10 which is opened to the inclined surface. The water flows downward along the inclined surface 35 toward the lower side of the inclined surface 35. In addition, since the opening of the jet nozzle 10 is wide, having an angle of 120 degrees in the horizontal direction in the present example, a wide area of the higher side of the inclined surface 35 can be sprinkled with water ejected from each sprinkler nozzle 7. By letting the water flow to the lower side along the incline of the inclined surface 35, sufficient water can be supplied over the entire surface of the test course 1.

In addition, since the sprinkling operation is performed only on the higher side of the inclined surface 35 to let the water flow along the road surface, problems such as the driver's field of view being obstructed while driving on the test course 1 or the rider's body getting wet are eliminated, and tests can be conducted safely and effectively. Also, since water can be sprinkled at any time during a test, it is possible to maintain the uniformly wet condition of the road surface, and time lost due to the stopping of the sprinkling operation during the test can be eliminated. As a result the running test can be conducted smoothly while the acquisition of precise test data becomes possible.

Moreover, since the sprinkling operation using the sprinkler nozzle 7 utilizes the incline of the test course 1, it is not necessary to eject water as far as the sprinkler 2. Therefore, the sprinkler nozzles 7 can be constructed easily without using a high-pressure jet mechanism or giving consideration to pressure resistance.

Since the sprinkler head 11 of the sprinkler nozzle 7 is structured flush with the road surface of the test course 1 and secured with paving material, even if a vehicle runs over it the sprinkler nozzle 7 will not be damaged or destroyed, nor will the running of the vehicle be disrupted.

Figure 6:
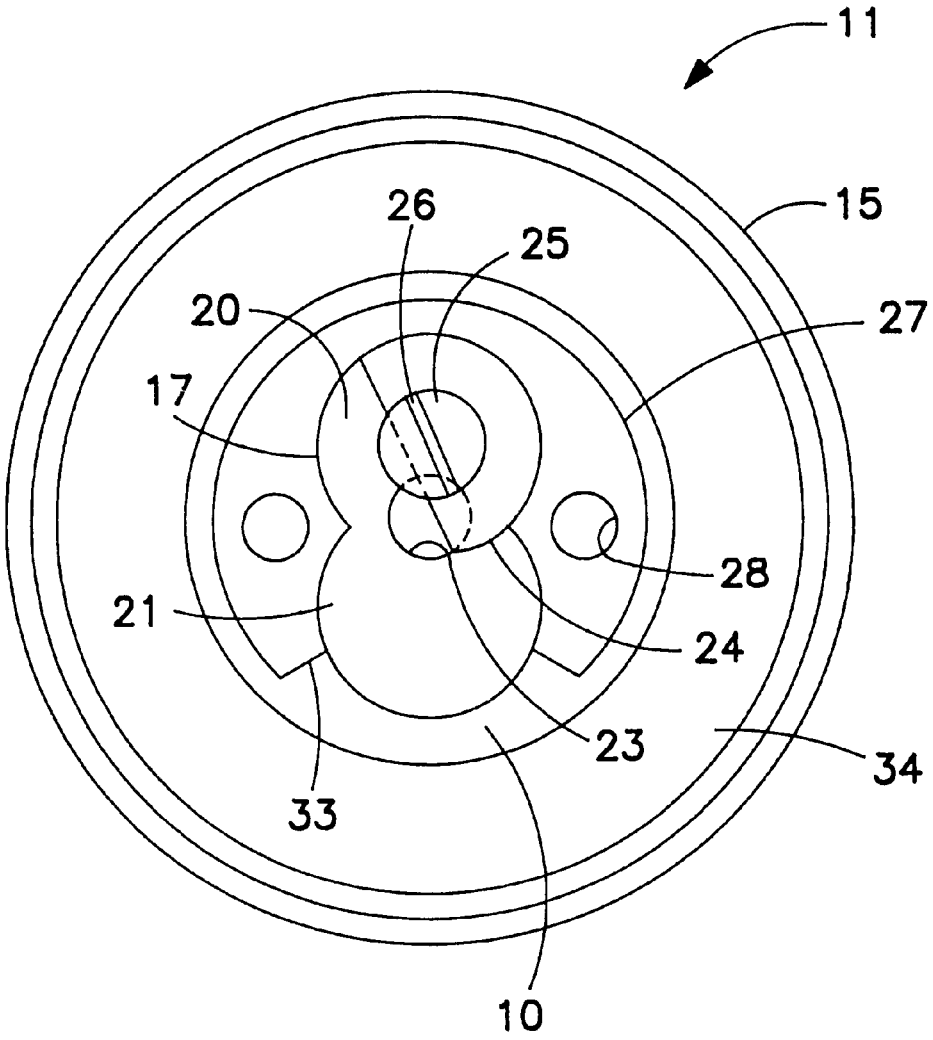
FIG. 6 is a top plan view of the sprinkler head illustrating by phantom lines an open-shut block covering a portion of a water inlet.

With respect to the sprinkler nozzles 7 of the present implementation example, because a water volume adjustment mechanism is provided, tests can be conducted by assuming a variety of conditions, such as heavy rain or drizzle, depending upon the purpose of the test. To adjust the water volume, a flathead screwdriver or similar tool can be inserted into the concave slot 26 of the adjustment screw 25, which is exposed on the cap piece 18 of the sprinkler nozzle 7, and rotated in the horizontal direction. The open-shut block 24 connected to the adjustment screw 25 then slides in the horizontal direction inside the first compartment 20 of the water-volume adjustment chamber 17. By this sliding action, the water inlet 23 is partially covered as shown in FIG. 6, and the water volume flowing into the adjustment chamber 17 from the jet passage 16 is limited, thereby reducing the amount of water sprinkled from the sprinkler nozzle 7.

Moreover, with respect to the sprinkler nozzles 7, since multiple sprinkler nozzles 7 are connected in series to the water-conduit pipe 12, the sprinkler nozzles 7 located far away from the water supply source will have reduced water pressure inside the water-conduit pipe 12, which may prevent the supply of a sufficient amount of water. However, by utilizing the water volume adjustment mechanism of the sprinkler nozzle 7 as described in the present implementation example, it is possible to supply water to all sprinkler nozzles 7 uniformly. This is done by the following method.

The jet passage 16 of the sprinkler nozzle 7 located nearest the water-supply source is adjusted by rotating the open-shut block 24 and limiting the amount of water supply to the sprinkler nozzle 7 located nearest the water-supply source. The jet passage 16 of each successive sprinkler nozzle 7 is widened in such a way that the opening of the sprinkler nozzle 7 located furthest away from the water supply source becomes the widest. By increasing the amount of water supply in this step-wise manner, the amount of water sprinkled from multiple sprinkler nozzles 7, which are arranged in series, can be maintained uniform. As a result, water can be sprinkled over the entire surface of the test course 1. Thus, the sprinkler nozzles 7 of the present implementation example can perform the water-volume adjustment in a simple, reliable manner without having a complex water-pressure adjustment mechanism.

Furthermore, while it is indicated in the implementation example described above that the jet nozzle 10 of the sprinkler nozzle 7 is capable of sprinkling water in a 120-degree range, the spray angle of the jet nozzle 10 can be set to an arbitrary range, for instance, 90, 180 or 360 degrees, by adjusting the fan-shaped cut angle of the cut section 33 of the gasket 27. When sprinkling water over 360 degrees, the upper face of the head body 15 is connected to the cap piece 18, while providing a gap between them and not using the gasket 27, such that water can be sprinkled over 360 degrees through the gap. In this instance, the inclined surfaces 35 of the test course 1 should be inclined in the left and right directions, by making the center of the test course 1 high and both sides of the test course 1 low. Then, install the sprinkler nozzles 7 at the center of the test course 1, so that water flows to the lower sides on the left and right along the inclined surfaces 35, so that water can be sprinkled over the entire surface.

In addition to the sprinkler nozzles 7 having the structure described in the implementation example above, appropriate sprinkler nozzles 7 using known conventional technology can also be employed if they are capable of sprinkling water only onto the higher side of the inclined surface of the test course 1.

Moreover, while the concave placement channel 3 and the concave installation channel 8 are constructed separately and the sprinklers 2 and the sprinkler nozzles 7 are installed in each channel in the implementation example described above, as a different implementation example a single channel may be constructed to serve as both the concave placement channel 3 and concave installation channel 8. In this case, it becomes unnecessary to dig multiple channels, and the sprinkler system of the present invention can be constructed by installing the sprinkler nozzles 7 into a sprinkler system that uses known conventional technology and employs only the sprinklers 2. The sprinklers 2 and sprinkler nozzles 7 may be constructed in series at given intervals to a single water-conduit pipe 4, or the system may be such that the water-conduit pipe 4 to which the sprinklers 2 are connected and the water-conduit pipe 12 to which the sprinkler nozzles 7 are connected are placed inside the channel in parallel. In either case, it is desirable to design the sprinklers 2 and sprinkler nozzles 7 appropriately, according to the size of the test course 1 to which they are installed, as well as the available budget.

The present invention sprinkles water over the entire surface of the test course both rapidly and uniformly by the sprinkling operation prior to the start of the vehicle running test. Therefore, preparatory work for the running test can be carried out efficiently within a short period of time. Subsequently, during the vehicle running test, sprinklers are stopped and the sprinkling operation is performed by the sprinkler nozzles. The sprinkling operation by the sprinkler nozzles can provide water over the entire surface of the course by sprinkling only onto the higher side of the inclined surface of the test course, so that the water flows downward toward the lower side along the inclined surface.

Therefore, safe and effective vehicle running tests can be carried out without obstructing the driver's field of view, impacting the rider's body with water, or causing an accident such as falling or colliding with the vehicle in front. In addition, since the sprinkling operation can be performed during the vehicle running test, time lost as a result of disrupting the vehicle running test for a sprinkle operation during the running test can be eliminated, and the running test can be carried out efficiently. In addition, since the sprinkler nozzles can be constructed and installed easily, the whole sprinkler system can be constructed inexpensively.

It will be understood that various modifications can be made to the apparatus disclosed in this application without changing the scope of the invention as set forth in the Claims attached hereto.

What is claimed is:

1. A sprinkler system for a vehicle running test course having an incline in the direction of the width of said vehicle running test course such that said vehicle running test course has a higher side and a lower side, comprising:

a concave placement channel constructed on at least one of said higher side of said vehicle running test course and said lower side of said vehicle running test course;

a plurality of sprinklers capable of sprinkling water over said vehicle running test course, said plurality of sprinklers being installed in said concave placement channel;

a concave installation channel constructed on said higher side of said vehicle running test course; and a plurality of water sprinkler nozzles placed in said concave installation channel, whereby said plurality of water sprinkler nozzles sprinkle water onto said higher side of said vehicle running test course such that the sprinkled water flows downward toward the lower side of the vehicle running test course.

2. The sprinkler system of claim 1, wherein said plurality of water sprinkler nozzles are installed at a constant interval within said concave installation channel.

3. The sprinkler system of claim 1, further comprising a water conduit pipe installed inside said concave installation channel and a plurality of water supply pipes, each of said plurality of water supply pipes connecting one of said plurality of water sprinkler nozzles to said water conduit pipe.

4. The sprinkler system of claim 3, wherein each of said plurality of water sprinkler nozzles is installed at the upper face of said concave installation channel and said water conduit pipe is installed at a position lower than said water sprinkler nozzles inside said concave installation channel, such that the upper face of each of said plurality of sprinkler nozzles is flush with the surface of said vehicle running test course.

5. The sprinkler system of claim 1, wherein each of said plurality of water sprinkler nozzles includes:

a water jet nozzle through which water is emitted from said water sprinkler nozzle;

a water volume adjustment chamber that adjusts the water volume flowing to said water jet nozzle;

an open-shut block inside said water volume adjustment chamber that is rotatable within said water volume adjustment chamber; and an adjustment screw accessible from the upper face of said water sprinkler nozzle, said adjustment screw being affixed to said open-shut block, whereby rotating said adjustment screw rotates said open-shut block within said water volume adjustment chamber, which adjusts the water volume flowing to said water jet nozzle, which adjusts the volume of the water emitted onto the surface of said vehicle running test course.

6. The sprinkler system of claim 1, wherein said concave placement channel is constructed separately from said concave installation channel.

7. The sprinkler system of claim 1, wherein said concave placement channel is the same as said concave installation channel.

8. The sprinkler system of claim 7, wherein said sprinklers and said sprinkler nozzles are arranged at constant intervals.

9. A sprinkling method for a vehicle running test course having an incline in the direction of the width of the vehicle running test course such that the vehicle running test course has a higher side and a lower side, comprising the steps of:

sprinkling water from a plurality of sprinklers placed on at least one of the higher side of the vehicle running test course and the lower side of the vehicle running test course with sufficient force that the sprinkled water reaches the entire surface of the test course;

thereafter, terminating the sprinkling water from the plurality of sprinklers; and sprinkling water from a plurality of sprinkler nozzles placed on the higher side of the vehicle running test course, whereby the sprinkled water flows downward along the surface of the vehicle running test course towards the lower side of the vehicle running test course causing the entire surface of the vehicle running test course to remain wet.

10. The sprinkling method of claim 9, wherein said sprinkling water from a plurality of sprinkler nozzles step is performed by a plurality of sprinkler nozzles installed in a concave installation channel such that the upper face of each of said plurality of sprinkler nozzles is flush with said vehicle running test course.

11. The sprinkling method of claim 9, wherein said sprinkling water from a plurality of sprinkler nozzles step is performed by a plurality of sprinkler nozzles, each of the plurality of sprinkler nozzles including a water jet nozzle through which water is emitted from said sprinkler nozzle; a water volume adjustment chamber that adjusts the water volume flowing to said water jet nozzle; an open-shut block inside said water volume adjustment chamber that is rotatable within said water volume adjustment chamber; and an adjustment screw accessible from the upper face of said sprinkler nozzle, said adjustment screw being affixed to said open-shut block;

whereby rotating said adjustment screw rotates said open-shut block within said water volume adjustment chamber, thereby adjusting the water volume flowing to said water jet nozzle, thereby adjusting the volume of water emitted onto the surface of said vehicle running test course.

12. The sprinkling method of claim 9, wherein said sprinkling water from a plurality of sprinklers step is performed by sprinklers placed in a concave placement channel, and said sprinkling water from a plurality of sprinkler nozzles step is performed by sprinkler nozzles placed in a concave installation channel, said concave placement channel being constructed separately from said concave installation channel.

13. The sprinkling method of claim 9, wherein said sprinkling water from a plurality of sprinklers step is performed by sprinklers placed in a concave installation channel, and said sprinkling water from a plurality of sprinkler nozzles step is performed by sprinkler nozzles placed in said concave installation channel.

14. The sprinkling method of claim 9, wherein said sprinkling water from a plurality of sprinklers step is performed by sprinklers placed in a concave installation channel, and said sprinkling water from a plurality of sprinkler nozzles step is performed by sprinkler nozzles placed in said concave installation channel, and wherein said sprinklers and said sprinkler nozzles are arranged at constant intervals in said concave installation channel.

15. A sprinkler system for a vehicle running test course having an incline in the direction of the width of said vehicle running test course such that said vehicle running test course has a higher side and a lower side, comprising:

a water source; and a plurality of sprinkler nozzles coupled to said water source, and positioned to effect a low profile flow of water down said incline.

16. The sprinkler system of claim 15, further comprising a plurality of sprinklers coupled to said water source and having a high profile spray pattern for wetting said vehicle running test course prior to conducting a test.

17. The sprinkler system of claim 16, wherein said plurality of sprinklers are activated prior to conducting said test and said plurality of sprinklers are deactivated during said test.

18. The sprinkler system of claim 17, wherein said plurality of sprinkler nozzles for supplying water to said higher side of said incline are activated during said test.

* * * * *

UNITED STATES PATENT AND TRADEMARK OFFICE

CERTIFICATE OF CORRECTION

PATENT NO. : 6,047,897

DATED : April 11, 2000

INVENTOR(S) : Hiroshi Ueno, et. al.

It is certified that error appears in the above-indentified patent and that said Letters Patent is hereby corrected as shown below:

Title page, item [30], should read -- Japanese Patent Application No. 295328, filed October 28, 1997--

Signed and Sealed this

Twentieth Day of March, 2001

Nicholas P. Godici

*Attest:*

NICHOLAS P. GODICI

*Attesting Officer*

*Acting Director of the United States Patent and Trademark Office*